US011694856B2

(12) United States Patent
Niu et al.

(10) Patent No.: US 11,694,856 B2
(45) Date of Patent: *Jul. 4, 2023

(54) HIGH VOLTAGE RELAY RESISTANT TO INSTANTANEOUS HIGH-CURRENT IMPACT

(71) Applicants: Xi'an Jiaotong University, Xi'an (CN); Huawei Technologies Co., Ltd., Shenzhen (CN)

(72) Inventors: Chunping Niu, Xi'an (CN); Yi Wu, Xi'an (CN); Xufeng Kang, Xi'an (CN); Fei Yang, Xi'an (CN); Mingzhe Rong, Xi'an (CN); Guangchao Yan, Dongguan (CN); Qingyin Fang, Dongguan (CN)

(73) Assignees: Xi'an Jiaotong University, Xi'an (CN); Huawei Technologies Co., Ltd., Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/684,093

(22) Filed: Mar. 1, 2022

(65) Prior Publication Data

US 2022/0189708 A1 Jun. 16, 2022

Related U.S. Application Data

(63) Continuation of application No. 16/858,314, filed on Apr. 24, 2020, now Pat. No. 11,289,280, which is a (Continued)

(30) Foreign Application Priority Data

Oct. 25, 2017 (CN) ..... 201711057040.X
Oct. 25, 2017 (CN) ..... 201721387275.0

(51) Int. Cl.
*H01H 1/54* (2006.01)
*H01H 50/18* (2006.01)
(Continued)

(52) U.S. Cl.
CPC ..... *H01H 1/54* (2013.01); *H01H 50/18* (2013.01); *H01H 50/36* (2013.01); *H01H 50/443* (2013.01); *H01H 50/58* (2013.01)

(58) Field of Classification Search
CPC ..... H01H 1/54; H01H 50/36
(Continued)

(56) References Cited

U.S. PATENT DOCUMENTS 3,614,353 A * 10/1971 Yoshio ..... H01H 33/666 335/15
6,140,894 A * 10/2000 Lane ..... H01H 77/101 335/142

(Continued)

FOREIGN PATENT DOCUMENTS

CN 101231923 A 7/2008
CN 103715022 A 4/2014

(Continued)

OTHER PUBLICATIONS

U.S. Appl. No. 16/858,314, filed Apr. 24, 2020.

*Primary Examiner* — Alexander Talpalatski
(74) *Attorney, Agent, or Firm* — Leydig, Voit & Mayer, Ltd.

(57) ABSTRACT

A high voltage relay resistant to instantaneous high-current impact is disclosed, and includes an electromagnet system, a control system, a contact system, and a base support. In the present solution, an electromagnetic force generated by the contact system is used to resolve a problem of contact separation caused by an electric repulsion force generated by an instantaneous high-current.

13 Claims, 2 Drawing Sheets

Related U.S. Application Data continuation of application No. PCT/CN2018/109552, filed on Oct. 10, 2018.

(51) Int. Cl.
*H01H 50/36* (2006.01)
*H01H 50/44* (2006.01)
*H01H 50/58* (2006.01)

(58) Field of Classification Search
USPC ..... 335/16, 147, 195
See application file for complete search history.

(56) References Cited

U.S. PATENT DOCUMENTS

| | | | | |
|---|---|---|---|---|
| 8,587,394 | B1 | 11/2013 | Song | |
| 9,570,826 | B2 * | 2/2017 | Chen | H01H 33/025 |
| 2010/0066468 | A1 | 3/2010 | Iwamoto et al. | |

FOREIGN PATENT DOCUMENTS

| | | | |
|---|---|---|---|
| CN | 103715024 | A | 4/2014 |
| CN | 203674097 | U | 6/2014 |
| CN | 104091706 | A | 10/2014 |
| CN | 203983083 | U | 12/2014 |
| CN | 104362044 | A | 2/2015 |
| CN | 204303697 | U | 4/2015 |
| CN | 104969325 | A | 10/2015 |
| CN | 105161368 | A | 12/2015 |
| CN | 205303358 | U | 6/2016 |
| CN | 106486324 | A | 3/2017 |
| CN | 106504949 | A | 3/2017 |
| CN | 107706055 | A | 2/2018 |
| CN | 207542152 | U | 6/2018 |
| DE | 102014106957 | A1 | 7/2015 |
| EP | 3089190 | A1 | 11/2016 |
| GB | 682667 | A | 11/1952 |
| JP | H02126348 | U | 10/1990 |
| JP | H1036161 | A | 2/1998 |
| JP | 2006032131 | A | 2/2006 |
| JP | 2007294253 | A | 11/2007 |
| JP | 2010073323 | A | 4/2010 |

* cited by examiner

HIGH VOLTAGE RELAY RESISTANT TO INSTANTANEOUS HIGH-CURRENT IMPACT

CROSS-REFERENCE TO RELATED APPLICATIONS

This application is a continuation of U.S. patent application Ser. No. 16/858,314, filed on Apr. 24, 2020, which is a continuation of International Application No. PCT/CN2018/109552, filed on Oct. 10, 2018, which claims priority to Chinese Patent Application No. 201711057040.X, filed on Oct. 25, 2017 and Chinese Patent Application No. 201721387275.0, filed on Oct. 25, 2017. All of the aforementioned patent applications are hereby incorporated by reference in their entireties.

STATEMENT OF JOINT RESEARCH AGREEMENT

The subject matter and the claimed disclosure were made by or on the behalf of Xi'an Jiaotong University, of Beilin District, Xi'an, Shaanxi Province, P.R. China and Huawei Technologies Co., Ltd., of Shenzhen, Guangdong Province, P.R. China, under a joint research agreement. The joint research agreement was in effect on or before the claimed disclosure was made, and that the claimed disclosure was made as a result of activities undertaken within the scope of the joint research agreement.

TECHNICAL FIELD

The present disclosure relates to a high voltage relay, and in particular, to a high voltage relay resistant to instantaneous high-current impact.

BACKGROUND

An electromagnet relay is an electromechanical component widely used in power control, an automatic industrial apparatus, a household appliance, and the like. The electromagnet relay is actually a "switch" that controls a relatively high current and/or a relatively high voltage by using a relatively low current and/or a relatively low voltage, and the relay can be used for automatic adjustment, safety protection, circuit switching, and the like in a circuit or apparatus.

In power distribution of an HVDC (high-voltage direct current) power supply in a communications system, a one-to-many power supply mode is mostly used. When a branch fails (an insulation failure, a short circuit, and the like), a voltage drop of a bus is caused. Consequently, a power failure is caused to another branch. To improve power supply reliability of the HVDC power supply, a miniaturized relay is required, so that when a branch of the HVDC power supply fails, the branch can be isolated rapidly and automatically. In addition, a working condition of an HVDC power supply relay in the communications system is in outdoor communications facilities. Therefore, there is a relatively high requirement on resisting impact of a lightning current (e.g., a significant current above a working current of the relay caused by electrical discharge of lightning through relay components).

In an existing electromagnetic relay with a straight conductive plate, when there is an instantaneous high current, an electric repulsion force between contacts is far greater than contact terminal pressure. As a result, the contacts are separated due to the repulsion force and a strong electric arc is generated. Consequently, the contacts are melted and burnt due to an instantaneous high temperature caused by the electric arc. The electromagnetic relay is designed mainly based on the Lorentz force principle. In an existing public patent, deformation of a movable spring plate is mainly used to exert contact pressure on a movable contact and a static contact. A resistible amount of a short circuit current is closely related to a distance between two spring plates and deformation of the spring plates. Therefore, the manner of using the deformation of the spring plate is difficult to adapt to a relatively large impulse current. Contacts are separated through deformation of the spring plate, which is difficult to resist a relatively large impulse current; and a breaking speed is limited. Factors such as stiffness, deformation, and fatigue of the spring plate have severe impact on a mechanical and/or an electrical life of the electromagnetic relay. In addition, the spring plate has a relatively high requirement on a processing technique, and a material property of the spring plate determines that the distance between the movable contact and the static contact is limited in a separated state, thereby limiting improvement of a working condition level and an insulation and overvoltage protection level of the distance.

SUMMARY

For the foregoing disadvantages, the present disclosure provides a high voltage relay resistant to instantaneous high-current impact. Rapid breaking of a current can be implemented by properly designing a contact structure and a control system, and an overvoltage protection level can be improved by increasing a distance between a movable contact and a static contact.

A high voltage relay resistant to instantaneous high-current impact includes: an electromagnet system, a control system, a contact system, and a base support. The electromagnet system is connected to the control system, and is configured to generate a magnetic field to provide a driving force for the control system. The control system is connected to the contact system, and is configured to control contacts in the contact system to open and close. The contact system generates an electromagnetic force when an instantaneous high current passes the high voltage relay, to offset an electric repulsion force between the contacts.

The electromagnet system includes a magnetic yoke, a coil framework, a movable iron core, and a static iron core. The coil framework is fastened on outer sides of the movable iron core and the static iron core. The magnetic yoke is wrapped around the upper, lower, left, and right sides of the movable iron core, the static iron core, and the coil framework to form a magnetic circuit.

The control system includes a transmission shaft, a contact spring, a retractile spring, and a movable contact support. The contact spring and the retractile spring are wound around the transmission shaft. The transmission shaft passes through the movable contact support and is connected to the movable contact support by using a jump ring.

The contact system includes a current inflow plate, a movable copper plate, a connecting piece, a current outflow plate, a movable contact, a static contact, and a waist circular hole. The current inflow plate and the current outflow plate are both fastened on the base support. The movable contact is fastened on the movable copper plate. The static contact is fastened on the current outflow plate. The connecting piece is riveted or welded onto the current inflow plate and the movable copper plate.

The movable iron core and the static iron core are annular and hollow, are made of a magnetic material having a permeability characteristic, and have a fixed air gap.

The movable iron core drives a transmission shaft to move after the high voltage relay is energized, so that a movable contact support and the movable copper plate move toward a direction of closing the contacts.

The contact spring is configured to provide contact pressure, so that the movable contact and the static contact can be in reliable contact.

The retractile spring is configured to drive the movable contact support by using the transmission shaft, to rapidly separate the movable contact from the static contact.

The current inflow plate and the movable copper plate generate a magnetic field through interaction when an instantaneous high current passes the high voltage relay, so that the movable copper plate generates an electromagnetic force in an opposite direction of an electric repulsion force between the contacts.

An overtravel is set between the movable contact and the static contact.

Compared with the prior art, the present disclosure brings the following beneficial technical effects.

In the present disclosure, on a basis that outline dimensions of a product are not increased, and power consumption of a coil control part is not increased, rapid breaking of a current can be implemented by properly designing a contact structure and a control system, and an overvoltage protection level can be improved by increasing a distance between a movable contact and a static contact, which is more applicable to an overvoltage condition. In addition, an electromagnetic force generated by currents in opposite directions on a current inflow copper plate and a movable copper plate is used to resist an electric repulsion force, between the movable contact and the static contact, generated by an instantaneous high current. The relay has a compact structure, strong impact and vibration resistance performance, a long electrical life and mechanical life, and a low price, and can be produced in batches.

DESCRIPTION OF EMBODIMENTS

The following describes the technical solutions of the present disclosure in detail with reference to the accompanying drawings and the embodiments.

Figure 1:
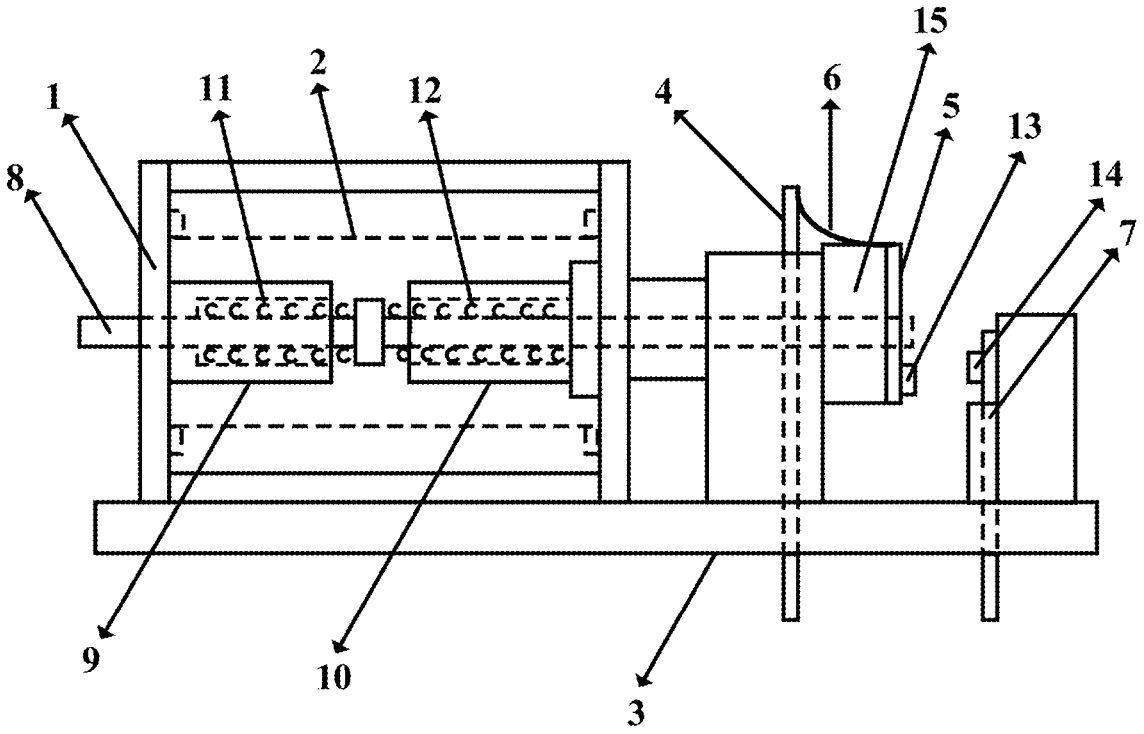
FIG. 1 is a schematic structural diagram of a high voltage relay resistant to instantaneous high-current impact in an embodiment.

FIG. 1 shows a high voltage relay resistant to instantaneous high-current impact in an embodiment, including an electromagnet system, a control system, and a contact system. The electromagnet system includes a magnetic yoke 1, a coil framework 2, a coil (not shown in the figure), a movable iron core 9, and a static iron core 10. The control system includes a base support 3, a transmission shaft 8, a contact spring 11, a retractile spring 12, and a movable contact support 15. The contact system includes a current inflow plate 4, a movable copper plate 5, a connecting piece 6, a current outflow plate 7, a movable contact 13, and a static contact 14. In this embodiment, the transmission shaft 8 is wound with the contact spring 11 and the retractile spring 12, and sequentially passes through the movable iron core 9 and the static iron core 10. Preferably, the movable iron core 9 and the static iron core 10 are annular and hollow, are made of a permeability magnetic material, and have a fixed air gap. The transmission shaft 8 further passes through the movable contact support 15 and is connected to the movable contact support 15 by using a jump ring. A surface of the coil framework 2 is covered with an insulation layer, and is fastened on outer sides of the iron core 9 and the static iron core 10. The magnetic yoke 1 is wrapped around the upper, lower, left, and right sides of the movable iron core 9, the static iron core 10, and the coil framework 2 to form a magnetic circuit. The current inflow plate 4 and the current outflow plate 7 are both fastened on the base support 3. The movable copper plate 5 is fastened on the movable contact support 15. The movable contact 13 is fastened on the movable copper plate 5. The static contact 14 is fastened on the current outflow plate 7. The current inflow plate 4 and the movable copper plate 5 are connected through a soft connecting piece 6 (e.g., a copper soft connecting piece or an aluminum soft connecting piece). One end of the soft connecting piece 6 is welded or riveted onto the current inflow plate 4, and the other end is welded or riveted onto the movable copper plate 5.

Figure 2:
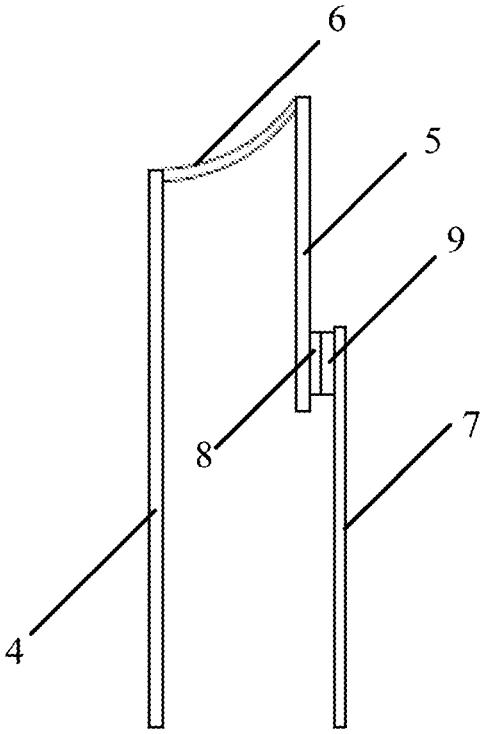
FIG. 2 is a schematic diagram of closed contacts in a contact system in FIG. 1.
Figure 3:
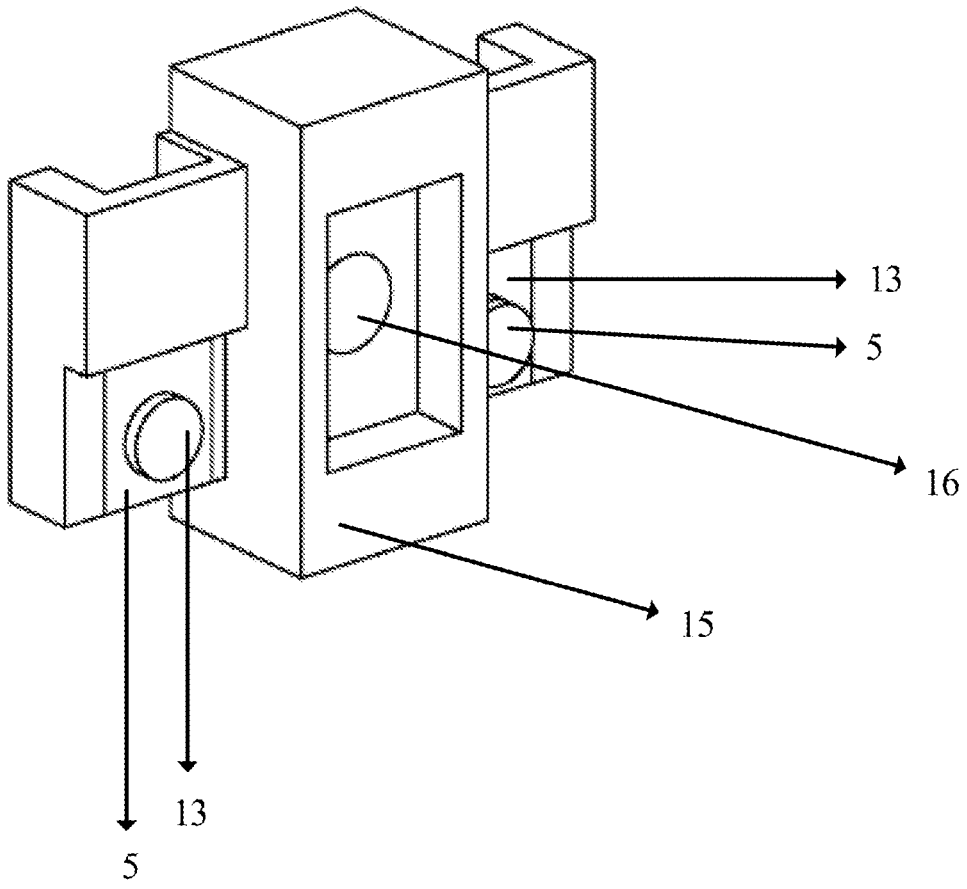
FIG. 3 is a schematic structural diagram of the movable copper plate and the movable contact support shown in FIG. 1.

In the foregoing structure, after the coil is energized, the movable iron core 9 moves, under an action of a magnetic field generated by the coil, toward a direction of narrowing the air gap. The movable iron core 9 drives the transmission shaft 8, to enable the movable contact support 15, the movable copper plate 5 fastened on the movable contact support 15, and the current inflow plate 4 to move toward a direction of closing the contacts. The moving direction is a normal direction of a contact section. In the moving process, the transmission shaft 8 is controlled by the coil and the movable iron core 9 to push the movable contact support 15. At the same time, the contact spring 11 and the retractile spring 12 are compressed. The contact spring 11 exerts pressure to the movable contact support 15, so that the movable contact 13 and the static contact 14 are in reliable contact. After the movable contact 13 and the static contact 14 are closed, the contact spring 11 provides proper contact pressure. As shown in FIG. 2, the contacts can be stably closed. To ensure a life of the contacts, a specific overtravel is set between the movable contact 13 and the static contact 14. In addition, to further ensure that the movable contact 13 and the static contact 14 are in reliable contact, a circular hole 16 is provided in the middle of the movable contact support 15. As shown in FIG. 3, the circular hole is used to fine-tune the movable contact support 15 within a relatively small range, thereby facilitating good contact between the movable contact 13 and the static contact 14.

After the coil is energized, an instantaneous high current may pass the high voltage relay. In this case, a current in the current inflow plate 4 and a current in the movable copper plate 5 are in opposite directions and interact with each other to generate a magnetic field. The movable copper plate 5 generates an electromagnetic force under an action of the magnetic field. In other words, the electromagnetic force and an electric repulsion force between the contacts are in opposite directions. The electromagnetic force is exerted on the movable contact 13 and the static contact 14 by using the movable contact support 15, thereby avoiding deformation of the movable copper plate 5. In this embodiment, a length and an installation manner of the movable copper plate 5 are properly set, so that the generated electromagnetic force completely offsets the electric repulsion force between the contacts.

After the coil is de-energized, under an action of the retractile spring 12, the transmission shaft 8 drives the movable contact support 15 to rapidly separate the movable contact 13 from the static contact 14, thereby implementing rapid breaking. To extinguish an electric arc as quickly as possible, in this embodiment, a permanent magnet is disposed on two sides of a contact area to blow the electric arc out, so that the electric arc is rapidly stretched and extinguished.

The control system designed in this embodiment can well control contact between the movable contact and the static contact when the relay is energized, and can effectively ensure the life of the contacts by setting the overtravel between the contacts. When the relay encounters instantaneous high-current impact, the contact system uses the generated magnetic field to offset the electric repulsion force between the movable contact and the static contact, to avoid deformation of an internal apparatus of the relay. After the relay is de-energized, the control system drives the movable contact and the static contact to implement rapid breaking.

Although the present disclosure has been disclosed above with examples of various embodiments, the present disclosure is not intended to limit the scope of the claims recited herein. Any person skilled in the art may, without departing from the scope of the present disclosure, make some conceptions or modifications to equivalent variations by using the foregoing disclosed technical content, however, any amendments, equivalent variations, and modifications that are made to the foregoing embodiments according to the technical essence of the present disclosure without departing from the content of the present disclosure still fall within the scope of the technical solutions of the present disclosure.

What is claimed is:

1. A high voltage relay resistant to instantaneous high-current impact, comprising:

an electromagnet system, a control system, a contact system, and a base support, wherein the electromagnet system is connected to the control system, and the electromagnet system is configured to generate a magnetic field to provide a driving force for the control system; the control system is connected to the contact system, and the control system is configured to control contacts in the contact system to open and close; and the contact system generates an electromagnetic force when an instantaneous high current passes the high voltage relay, to offset an electric repulsion force between the contacts;

wherein the contact system comprises a current inflow plate, a movable copper plate, a connecting piece, a current outflow plate, a movable contact, and a static contact; the current inflow plate and the current outflow plate are fastened on the base support; the movable contact is fastened on the movable copper plate, and the static contact is fastened on the current outflow plate; and the connecting piece is riveted or welded onto the current inflow plate and the movable copper plate; and wherein the connecting piece is a soft connecting piece.

2. The high voltage relay according to claim 1, wherein the current inflow plate and the movable copper plate generate a magnetic field through interaction when an instantaneous high current passes the high voltage relay, so that the movable copper plate generates an electromagnetic force in a direction opposite to that of the electric repulsion force between the contacts.

3. The high voltage relay according to claim 1, wherein an overtravel is set between the movable contact and the static contact.

4. The high voltage relay according to claim 1, wherein: the electromagnet system comprises a magnetic yoke, a coil framework, a movable iron core, and a static iron core; the coil framework is fastened on outer sides of the movable iron core and the static iron core; and the magnetic yoke is wrapped around the least four sides of the movable iron core, the static iron core, and the coil framework to form a magnetic circuit.

5. The high voltage relay according to claim 4, wherein the movable iron core and the static iron core are annular and hollow, are made of a magnetic material, and have a fixed air gap.

6. The high voltage relay according to claim 4, wherein the movable iron core drives a transmission shaft to move after the high voltage relay is energized, so that a movable contact support and the movable copper plate move toward a direction of closing the contacts.

7. The high voltage relay according to claim 1, wherein: the control system comprises a transmission shaft, a contact spring, a retractile spring, a movable contact support, and a circular hole; the contact spring and the retractile spring are wound around the transmission shaft, and the transmission shaft passes through the movable contact support, and is connected to the movable contact support by using a jump ring; and the circular hole is provided in the middle of the movable contact support.

8. The high voltage relay according to claim 7, wherein the contact spring is configured to provide contact pressure between the movable contact and the static contact.

9. The high voltage relay according to claim 7, wherein the retractile spring is configured to drive the movable contact support, by using the transmission shaft, to separate the movable contact from the static contact.

10. The high voltage relay according to claim 2, wherein the movable iron core drives a transmission shaft to move after the high voltage relay is energized, so that a movable contact support and the movable copper plate move toward a direction of closing the contacts.

11. The high voltage relay according to claim 3, wherein the movable iron core drives a transmission shaft to move after the high voltage relay is energized, so that a movable contact support and the movable copper plate move toward a direction of closing the contacts.

12. The high voltage relay according to claim 4, wherein the movable iron core drives a transmission shaft to move after the high voltage relay is energized, so that a movable contact support and the movable copper plate move toward a direction of closing the contacts.

13. The high voltage relay according to claim 5, wherein the movable iron core drives a transmission shaft to move after the high voltage relay is energized, so that a movable contact support and the movable copper plate move toward a direction of closing the contacts.

* * * * *